United States Patent [19]

Buchan et al.

[11] 4,007,707

[45] Feb. 15, 1977

[54] XEROGRAPHIC DEVELOPMENT APPARATUS HAVING A LARGE RESERVOIR FOR CONTROLLED FLOW THROUGH A NARROW DEVELOPMENT ZONE

[75] Inventors: W. Raymond Buchan, Lincoln; Edward F. Mayer, Acton, both of Mass.; James E. Gentle, Newton, Conn.

[73] Assignee: Itek Corporation, Lexington, Mass.

[22] Filed: Jan. 21, 1975

[21] Appl. No.: 542,886

[52] U.S. Cl. ..... 118/647; 355/3 DD

[51] Int. Cl.[2] ..... B05B 5/02; G03G 15/00

[58] Field of Search ..... 355/3 DD, 10, 14; 118/637, DIG. 24; 222/DIG. 1

[56] References Cited

UNITED STATES PATENTS

| | | | |
|---|---|---|---|
| 3,270,637 | 9/1966 | Clark | 355/10 X |
| 3,349,676 | 10/1967 | Hudson | 355/3 DD |
| 3,662,711 | 5/1972 | Hudson | 355/3 DD X |
| 3,685,488 | 8/1972 | Stover | 118/637 |
| 3,717,122 | 2/1973 | Hudson | 118/637 X |
| 3,754,526 | 8/1973 | Caudill | 355/3 DD X |
| 3,921,571 | 11/1975 | Moore et al. | 118/637 X |

*Primary Examiner*—Fred L. Braun
*Attorney, Agent, or Firm*—Homer O. Blair; Robert L. Nathans; David E. Brook

[57] ABSTRACT

A novel development system for controlling the flow rate of developer through a narrow development zone, using a reservoir which has a feed chamber for maintaining a constant pressure head at the entrance to the narrow development zone. Developer flow is initiated upon demand by virtue of actuation of a valve positioned between the feed chamber and the entrance to the development zone; since considerable developer mixing occurs in the developer reservoir, mixing devices for mixing added toner with carrier beads may be simplified.

4 Claims, 1 Drawing Figure

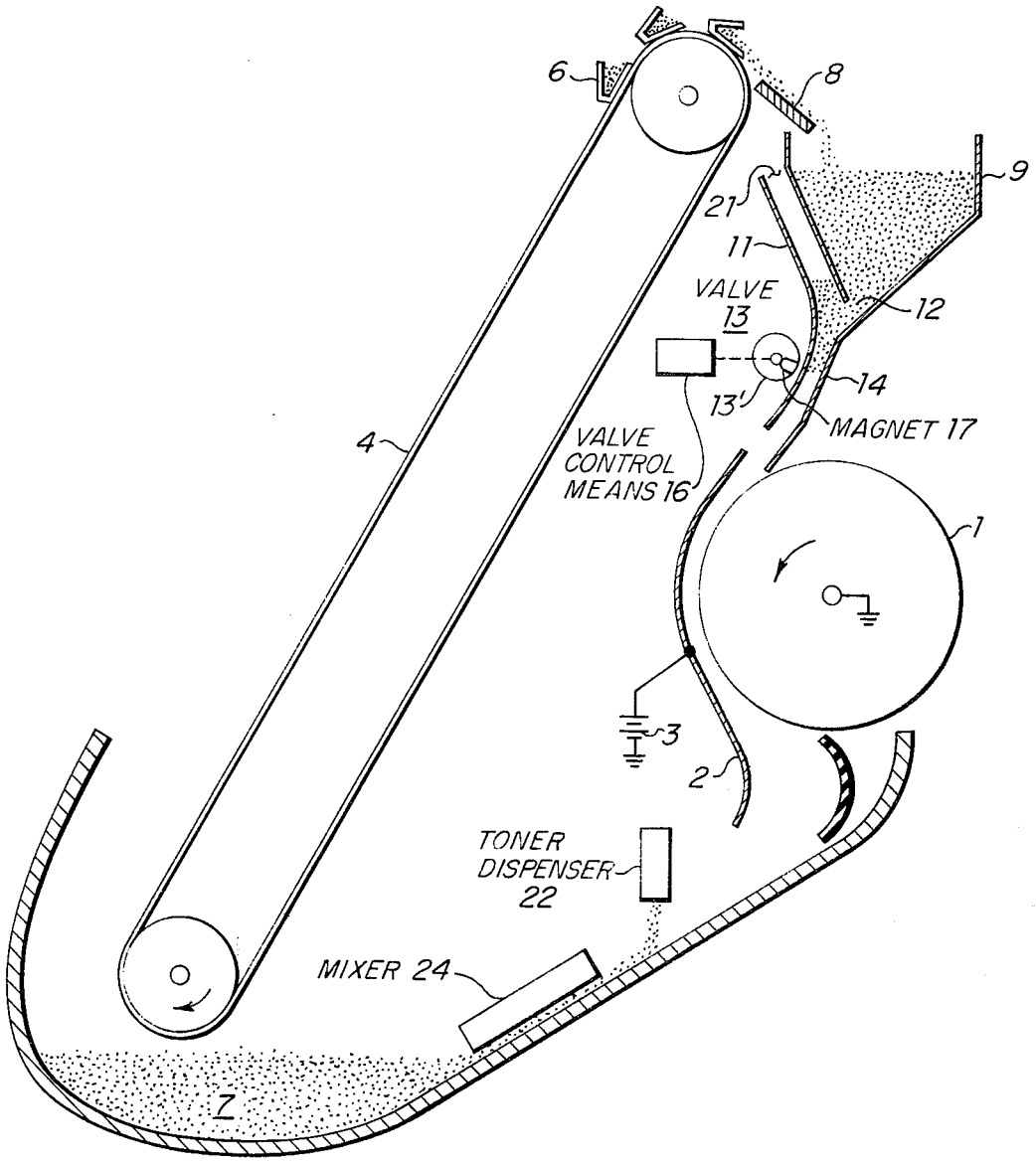
6
8
9
21
11
VALVE
13
12
14
13'
MAGNET 17
4
VALVE
CONTROL
MEANS 16
1
3
2
TONER
DISPENSER
22
MIXER 24
Z

XEROGRAPHIC DEVELOPMENT APPARATUS HAVING A LARGE RESERVOIR FOR CONTROLLED FLOW THROUGH A NARROW DEVELOPMENT ZONE

BACKGROUND OF THE INVENTION

In prior art cascade development arrangements, large quantities of developer are directed at the xerographic drum and circulate throughout the system at relatively high velocity, which produces developer wear owing to abrasion. Furthermore, the conveyer belts for conveying toner from lower portions of the system to upper portions for re-application to the drum normally operate at relatively high speeds of about 24 buckets per second. It is highly desirable to employ a belt conveyer which operates at considerably lower speeds to reduce wear and accompanying maintenance. In cases where an elongated development electrode defining a narrow development zone is utilized, it is highly desirable to maintain a constant pressure head of developer at the entrance of the narrow development zone in order to rapidly fill the zone upon start-up and maintain a relatively constant flow rate and constant conditions of partial toner turbulence.

The above-mentioned prior art developer conveyers additionally have toner mixers associated therewith to produce mixing of fresh toner with depleted carrier beads. This apparatus is relatively elaborate since such mixing must occur rapidly due to the above-mentioned high speed of the conveyers which are required to maintain high developer throughput velocity. It is deemed desirable to eliminate toner mixing apparatus associated with a conveyer belt and to substitute simpler toner dispensing and mixing apparatus which need not provide the relatively rapid and thorough mixing otherwise required.

SUMMARY OF THE INVENTION

In accordance with a preferred embodiment of the present invention, a relatively large developer reservoir is positioned to feed developer through a feed channel into the upper portion of a narrow developer zone. A developer dispensing valve is associated with the feed channel to selectively permit developer to be fed through the narrow development zone during copying and to prevent such flow during the standby periods when copying is not taking place although the machine is in an "on" condition. A feed chamber communicating with the relatively large developer reservoir provides a relatively constant pressure head to maintain developer flow rates and at least partial turbulence conditions relatively constant. Since mixing of toner and carrier beads occurs in the reservoir and feed chamber, simpler toner mixing devices may be employed at the lower portion of the machine to reduce cost and machine complexity.

An additional major advantage of the developer reservoir and feed chamber arrangement is that peak demand at the start-up portion of the cycle may be readily satisfied due to the resulting pressure head produced by the feed chamber, which causes developer to rapidly fill the development zone, and lower portions of the machine. After passage of the peak development period, the elevator need merely cope with the mean demand which, once the system is in a steady state condition, is less than the peak demand and accordingly, a slower speed developer conveyer may be employed. In other words peak demand is not made upon the elevator at all, as such peak demand is satisfied by the reservoir and feed chamber arrangement. Furthermore, the feed chamber eliminates prior art developer overflow, and thus reduces the mean demand itself since developer is not spilling over and by-passing the development zone. Since the developer occupies the reservoir a large percentage of the time, developer wear is reduced. Overflowing developer also strikes the lower portions of the machine with considerable velocity so that eliminating overflow additionally reduces wear on the developer.

Other features and advantages of the present invention will become apparent upon perusal of the specific description.

BRIEF DESCRIPTION OF THE DRAWING

The sole FIGURE illustrates a preferred embodiment of the invention, including a developer conveyer system and a hopper positioned at the upper portion of the machine for feeding developer to the development zone.

SPECIFIC DESCRIPTION

Referring now to the sole FIGURE, a xerographic drum 1 is disclosed for development. Electrode 2 is positioned adjacent to the surface thereof as illustrated, thereby to define a narrow development zone. The electrode preferably is roughened as disclosed in U.S. patent application Ser. No. 429,616, filed Jan. 2, 1974, now abandoned, and assigned to the same assignee as the present invention. The electrode is biased by power supply 3 in the conventional manner. Low speed developer belt conveyer 4 is illustrated, having conventional buckets 6 for conveying developer from the lower portion of the machine 7 to a guide means 8 which facilitates in the transportation of developer into a relatively large developer reservoir 9 which in turn communicates with a feed chamber 11 via orifice 12. Valve 13 is positioned adjacent feed channel 14 and is controlled by any conventional valve control means.

A major portion of the developer, at least 50%, is stored within reservoir 9. When the valve assumes a first state, magnet 17 is positioned to cause a magnetic field to exist in the feed channel which in turn causes magnetizable carrier beads to stick together to form a conglomerate body to prevent flow of developer from the feed channel into the upper portion of the development zone. When the valve assumes a second state, the magnetic field is removed and the developer passes through the feed channel by virtue of gravity. Although the valve could take many forms, it is illustrated as a movable magnet. Valve control means 16 could comprise a conventional solenoid device for rotating the valve disc 13' to in turn position magnet 17 away from the developer feed channel. If one were to have a highly fluid developer, the overflow chamber would be closed at the top as indicated by dashed lines 21 to maintain the required constant pressure head. In the apparatus built by the inventors, developer was employed which had relatively little fluidity so that interparticle frictional forces prevented such overflow and maintained the level roughly in the position indicated in the FIGURE.

When the machine is in the standby condition wherein copying is not actually taking place, valve 13 prevents developer from being fed to the developer zone. Upon initiation of the copying cycle, valve control means 16 causes magnetic flux to be removed from the feed channel. The developer is fed to the development zone under the constant pressure head produced by the feed chamber, thereby to maintain relatively constant flow rates and at least partial unchanging turbulence conditions within the development zone which is of importance in consistently producing good quality copy. As mentioned above, the reservoir-feed chamber configuration provides for considerable toner-carrier bead mixing so that relatively simple and inexpensive toner mixing apparatus may be employed in the machine. A toner dispenser 22 feeds toner into the developer flow at 23 and mixer 24 provides for lateral mixing. Owing to the considerable mixing in the upper portion of the machine, mixer 24 may be relatively simple and inexpensive, and preferably consists of chute means having no moving parts. The chute means consists of baffles for directing centrally positioned developer toward outer portions of the flow and simultaneously directing developer at outer portions toward central portions for each pass of the developer through the mixer. Hence the above-mentioned relatively complex mixing devices required for high speed developer throughput machines are not required. Another form of mixer could have the configuration shown in a patent to Michael R. Stanley, U.S. Pat. No. 3,697,050. Toner dispenser 22 dispenses toner relatively uniformly across the developer flow and employs a foamed plastic auger positioned within a feed pipe having dispensing holes which is positioned transverse to the direction of development flow.

A preferred mode of operation maintains energization of the belt conveyer to fill the reservoir after copying and during the cleaning cycle, so that about 90% of the developer in the machine is fed into the reservoir before the conveyer belt stops. This substantially empties the conveyer buckets and sump. The operation of the belt conveyer during the cleaning cycle removes developer from the sump thus produces mixing of freshly added toner with depleted carrier beads in the sump together with further mixing as the developer is transported from the buckets to the reservoir.

In a second mode of operation, the belt conveyer stops as soon as copying ceases so that up to half of the developer remains in the conveyer buckets and sump. However, if the machine remains shut off, for example during the weekend, newly added toner might form agglomerate masses so that it is preferred to operate in the first mode to mix newly added toner with carrier beads as soon as possible.

Briefly, in summary, the major advantages of the above-described system may be characterized as having less development wear to thereby reduce development replacement rates, less complex mixing devices, the production of a constant pressure head for controlled development conditions, and the use of a low speed developer conveyer.

While a preferred embodiment of the invention has been described, the teachings of this invention will readily suggest many other embodiments to those skilled in the art.

What is claimed is:

1. A xerographic development apparatus for a xerographic machine comprising:

a. a xerographic member capable of carrying an electrostatic image;

b. a development electrode positioned adjacent said member for defining an elongated narrow development zone;

c. a developer reservoir for containing a substantial portion of the entire amount of developer within said xerographic machine;

d. valve means for controlling the flow of developer from said reservoir to said narrow development zone;

e. a developer transport mechanism for transporting developer having travelled through said development zone back to said developer reservoir; and f. a feed chamber, in communication with a lower portion of said reservoir, which produces a substantially constant pressure head of developer at the entrance of said narrow development zone, thereby to control and maintain a desired flow rate of developer passing through said narrow development zone regardless of the quantity of developer within said reservoir.

2. A xerographic development apparatus for a xerographic machine comprising:

a. a xerographic member capable of carrying an electrostatic image;

b. a development electrode positioned adjacent said member for defining an elongated narrow development zone;

c. a developer reservoir for containing a substantial portion of the entire amount of developer within said xerographic machine;

d. valve means for controlling the flow of developer from said reservoir to said narrow development zone, said developer including magnetizable carrier beads, said valve means including magnet means to cause the magnetizable carrier beads to stick together to form a body which prevents flow of developer to said narrow development zone when said valve means assumes a first state and which removes magnetic flux from said body in a second state, thereby to cause developer to flow from said reservoir into said narrow development zone;

e. a developer transport mechanism for transporting developer having travelled through said development zone back to said developer reservoir; and f. a feed chamber, in communication with a lower portion of said reservoir, which produces a substantially constant pressure head of developer at the entrance of said narrow development zone, thereby to control and maintain a desired flow rate of developer passing through said narrow development zone regardless of the quantity of developer within said reservoir.

3. A xerographic development apparatus for a xerographic machine, said development apparatus having an upper and lower portion, comprising:

a. a xerographic member capable of carrying an electrostatic image;

b. a development electrode positioned adjacent said member for defining an elongated narrow development zone;

c. a reservoir positioned at said upper portion of said development apparatus for containing a substantial portion of the entire amount of developer within said xerographic machine;

d. a feed channel for feeding developer from said reservoir to said development zone;

e. valve means for controlling the flow of developer from said reservoir to said narrow development zone, said developer including a toner;
f. a toner dispenser positioned at said lower portion of said development apparatus;
g. a developer mixing device positioned adjacent said toner dispenser for aiding in the dispensation of said toner within masses of developer passing through the lower portion of said machine after emerging from said narrow developer zone;
h. a developer transport mechanism for transporting the developer from the lower portion of said development apparatus to said developer reservoir; and
i. a feed chamber, in communication with a lower portion of said reservoir, which produces a substantially constant pressure head of developer at the entrance of said feed channel, thereby to control and maintain a desired flow rate of developer passing through said narrow development zone regardless of the quantity of developer within said reservoir.

4. A xerographic development apparatus for a xerographic machine, said development apparatus having an upper and lower portion, comprising:
a. a xerographic member capable of carrying an electrostatic image;
b. a development electrode positioned adjacent said member for defining an elongated narrow development zone;
c. a reservoir positioned at said upper portion of said development apparatus for containing a substantial portion of the entire amount of developer within said xerographic machine;
d. a feed channel for feeding developer from said reservoir to said development zone;
e. valve means for controlling the flow of developer from said reservoir to said narrow development zone, said developer including magnetizable carrier beads and toner, said valve means including magnet means to cause the magnetizable carrier beads to stick together to form a body which prevents flow of developer to said narrow development zone when said valve means assumes a first state and which removes magnetic flux from said body in a second state, thereby to cause developer to flow from said reservoir into said narrow development zone;
f. a toner dispenser positioned at said lower portion of said development apparatus;
g. a developer mixing device positioned adjacent said toner dispenser for aiding in the dispensation of said toner within masses of developer passing through the lower portion of said machine after emerging from said narrow developer zone;
h. a developer transport mechanism for transporting the developer from the lower portion of said development apparatus to said developer reservoir; and
i. a feed chamber, in communication with a lower portion of said reservoir, which produces a substantially constant pressure head of developer at the entrance of said feed channel, thereby to control and maintain a desired flow rate of developer passing through said narrow development zone regardless of the quantity of developer within said reservoir.

* * * * *